US006974902B2

(12) United States Patent
Adam

(10) Patent No.: US 6,974,902 B2
(45) Date of Patent: Dec. 13, 2005

(54) MUSIC SYNTHESIZER AND A METHOD OF GENERATING A SYNTHESIZER OUTPUT WITH A CONSTANT BEAT

(75) Inventor: Chris Adam, Norderstedt (DE)

(73) Assignee: Apple Computer, Inc., Cupertino, CA (US)

( * ) Notice: Subject to any disclaimer, the term of this patent is extended or adjusted under 35 U.S.C. 154(b) by 228 days.

(21) Appl. No.: 10/427,676

(22) Filed: Apr. 30, 2003

(65) Prior Publication Data

US 2004/0216587 A1 Nov. 4, 2004

(51) Int. Cl.[7] ..... G10H 5/00
(52) U.S. Cl. ..... 84/671
(58) Field of Search ..... 84/671–675

(56) References Cited

U.S. PATENT DOCUMENTS 1,823,724 A * 9/1931 Carlson ..... 84/698
1,940,093 A * 12/1933 Lindridge ..... 84/706
3,136,949 A * 6/1964 Firestone ..... 455/45

* cited by examiner

*Primary Examiner*—Jeffrey W Donels
(74) *Attorney, Agent, or Firm*—Blakely, Sokoloff, Taylor & Zafman LLP

(57) ABSTRACT

Prior art synthesizers often select a small interval d to detune. For example, if the nominal oscillator frequency was 1000 Hz, then applying a detune parameter of 10 cent would result in a detuned oscillator frequency of 1006 Hz. However, at the next octave, the nominal frequency would be 2000 Hz with the detuned oscillator frequency of 2012 Hz. Accordingly, a detuned oscillator has a frequency deviation which is proportional to its nominal frequency. Hence, when mixing detuned oscillators, the resulting signal has a beat frequency which varies with the pitch and doubles with each octave.

An aim of the present invention is to provide a music synthesizer whereby sounds are generated with a constant optimum beat across a large range of tones.

The present invention relates to a music synthesizer comprising a first and second oscillator and a signal generator which applies a constant beat parameter to a pitch signal to derive the input for said second oscillator, thereby enabling a synthesizer output to be generated at a substantially constant beat.

6 Claims, 1 Drawing Sheet

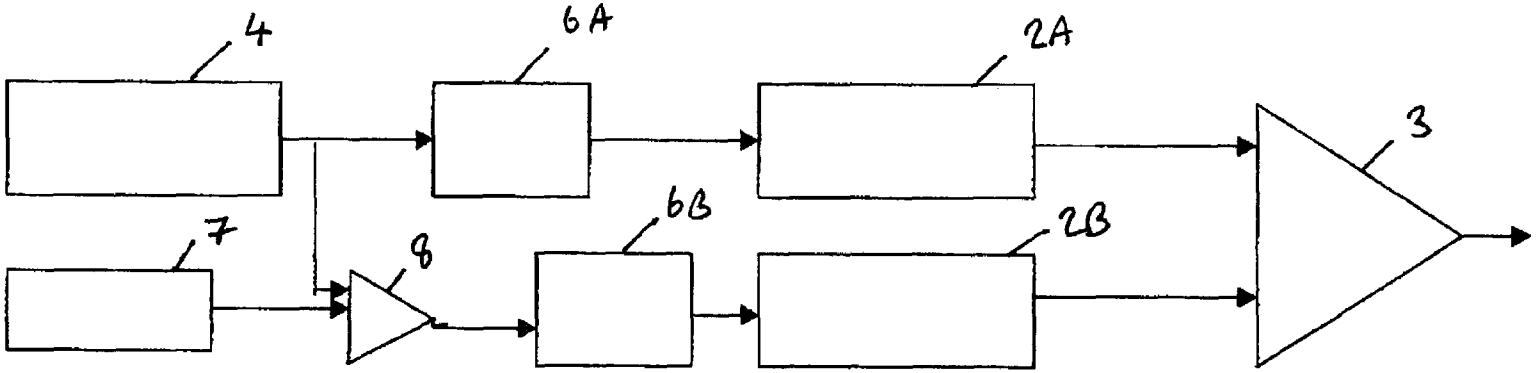
PRIOR ART Figure 1
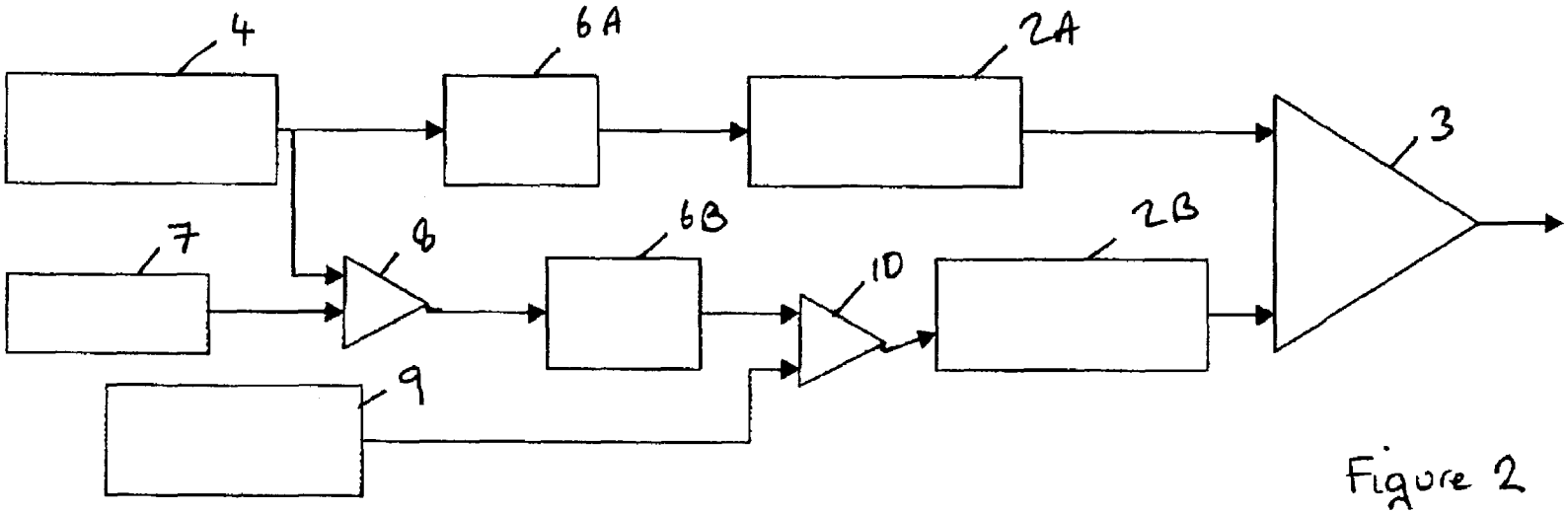
Figure 2

MUSIC SYNTHESIZER AND A METHOD OF GENERATING A SYNTHESIZER OUTPUT WITH A CONSTANT BEAT

FIELD OF THE INVENTION

The present invention relates to a music synthesizer and a method of generating a synthesizer output with a constant beat.

BACKGROUND OF THE INVENTION

Music synthesizer generate audio tones. Many synthesizers generate their tones by using one or more oscillators. It is very common to use several oscillators in a single synthesizer voice but with at least one oscillator detuned. That is to say, that oscillator is oscillating at a slightly different frequency to at least one other oscillator. As a consequence of interference, this results in a periodically changing resulting signal due to the varying phase difference between them.

When there are two slightly detuned sine waves, the resulting signal is perceived as a single sine wave with a sinusoidal amplitude modulation varying with frequency. The frequency of this amplitude modulation is called the "beat frequency". This can be expressed as follows:

| | |
|---|---|
| Oscillator A: | $a(t) = \sin(2\pi f_a t)$ |
| Oscillator B: | $b(t) = \sin(2\pi f_b t)$ |
| The resulting signal: s(t) | $= a(t) + b(t)$ |
| | $= \sin(2\pi f_a t) + \sin(2\pi f_b t)$ |
| | $= 2\sin(2\pi [f_a + f_b] t/2)\cos(2\pi [f_a - f_b] t/2)$ |

where $f_a$ is the frequency of oscillator A, $f_b$ is the frequency of oscillator B, a(t) is the output from oscillator A and b(t) is the output from oscillator B.

More often than not, there are two detuned oscillators producing more complex waveforms. Complex waveforms include waveforms in shapes which differ more or less from a perfect sine wave, e.g. a sawtooth or rectangular wave and can be decomposed into a sum of harmonic sine waves (the overtones or partial frequencies). The resulting interference from such complex waveforms is not a simple amplitude modulation but a complex timbre variation. This is because each pair of harmonic overtones has to be treated separately. However, the timbre variation when mixing two slightly detuned oscillators is still periodic with a beat frequency. Moreover, that beat frequency is equal to the difference between the two frequencies of the mixed detuned oscillators.

Synthesizer oscillators are usually tuned in a chromatic scale that consists of equal semitone intervals. An interval is defined by a certain frequency ratio between two tones. Twelve semitone interval steps result in an octave interval which is defined as a frequency ratio of 2:1. Hence, each semitone is the twelfth root of 2 or approximately 1.06. A semitone can be further divided into cents. A cent is one hundredth of a semitone. Thus, one cent is a 1200th root of 2 or approximately 1.0006.

In the prior art, synthesizer oscillators have been detuned by setting a certain detune interval which was usually measured in cents. Due to the fact that the detune interval defines the ratio between the detuned frequency and the nominal frequency, the frequency deviation itself is proportional to the nominal frequency. For example, if the nominal oscillator frequency was 1000 Hz, then applying a detune interval of 10 cent (approx. 1.006) would result in a detuned oscillator frequency of 1006 Hz and a beat frequency of 6 Hz. However, with the same detune interval of 10 cent at the next octave, the nominal frequency would be 2000 Hz with the detuned oscillator frequency of 2012 Hz and a beat frequency of 12 Hz. Accordingly, at a given detune interval the detuned oscillator has a frequency deviation which is proportional to its nominal frequency. Hence, when mixing detuned oscillators, the resulting signal has a beat frequency which varies with the pitch and doubles with each octave.

In order to accommodate for this beat frequency, a compromise is reached but often such audio tones have a beat frequency which is relatively too slow at lower tones and too high at higher tones.

An aim of the present invention is to provide a music synthesizer whereby sounds are generated with an optimum beat across a large range of tones.

SUMMARY OF THE INVENTION

The present invention is thus directed towards a music synthesizer which generates audio tones at a constant beat.

According to the present invention, there is provided a music synthesizer comprising a first and second oscillator coupled together and a signal generator of a constant beat parameter which is applied to a pitch signal to derive the input for said second oscillator, thereby enabling a synthesizer output to be generated at a substantially constant beat.

Also according to the present invention, there is provided a method of generating a synthesizer output with a constant beat from a music synthesizer having at least a first and second a oscillator, comprising:

generating a constant beat parameter;

adding said constant beat parameter to a pitch signal to derive the input for the second oscillator; and combining the output of the second oscillator and the output from the first oscillator to generate the synthesizer output with a substantially constant beat.

BRIEF DESCRIPTION OF THE DRAWINGS

An embodiment of the present invention will now be described by way of further example only and with reference to the accompanying drawing, in which:

FIG. 1 is an exemplary diagram of the circuit arrangement of the prior art; and FIG. 2 is an exemplary diagram of the circuit arrangement of the present invention.

DETAILED DESCRIPTION OF THE INVENTION

As discussed above, the beat frequency of detuned oscillators in synthesizers according to the prior art varies with the pitch and doubles with each octave. Expressed mathematically, the synthesizer combining two oscillators with a prior art detune linear parameter is a follows:

$$F = f_0 * (1 + d)$$

Where F is the beat frequency, $f_0$ is the nominal frequency which depends on the octave and the semitone setting used and d is the detune parameter.

The present invention utilises a constant beat detune $f_{cd}$. The constant beat detune parameter enables the oscillator to acquire a fixed absolute frequency deviation instead of one determined by an interval. Thus, the beat frequency is independent of the pitch or octave. Expressed mathematically again:

$$F=f_0*(1+d)+f_{cd}$$

FIG. 1 illustrates schematically a circuit diagram of the prior art. In FIG. 1, there are two oscillators 2A and 2B each oscillating with a nominal frequency $f_0$. The outputs of the oscillators are combined by an adder 3 to derive the synthesizer output. A linear pitch control signal generator 4 outputs a linear pitch control signal which has equal increments for each semitone. Each oscillator has a linear frequency response to the control input, e.g. its frequency is proportional to the control signal. Thus there is also an exponentiator 6A and 6B disposed between the linear pitch control signal generator and each oscillator so as to ensure that the equidistant steps in the control signal result in equal ratios between the according frequencies.

As discussed above, a detune parameter generator 7 producing a detune parameter d is added to the linear control signal of oscillator 2B using an adder 8. However, since the detune parameter is added prior to the exponentiation, the resulting signal has a beat frequency which varies with the pitch.

FIG. 2 illustrates schematically a circuit arrangement of the present invention. Many components are similar to that described and illustrated in the prior art and so retain the same reference numeral and the description thereof will be omitted. The present invention differs from the prior art by the introduction of a constant beat detune $f_{cd}$ from signal generator 9 which is combined with the output of the exponentiator 6B using a second adder 10.

Thus, the output of the music synthesizer is generated with a constant beat which is independent of the pitch or range of tones.

The foregoing description has been given by way of example only and it will be appreciated by a person skilled in the art that modifications can be made without departing from the scope of the present invention.

What is claimed is:

1. A music synthesizer comprising a first oscillator and a second oscillator and a generator which applies a constant beat parameter to a pitch signal to derive the input for said second oscillator which is coupled to said generator, the music synthesizer to generate a synthesizer output which is coupled to said first and said second oscillators, the synthesizer output to be generated at a substantially constant beat.

2. A music synthesizer as claimed in claim 1, further comprising a first and second exponentiator, said first exponentiator arranged to receive a linear pitch control signal and to derive the input for said first oscillator and said second exponentiator derives said pitch signal.

3. A music synthesizer as claimed in claim 2, further comprising an adder for combining a detune parameter with said linear pitch control signal to derive the input for said second exponentiator.

4. A music synthesizer as claimed in claim 3, further comprising a second adder coupled to said generator.

5. A method of generating a synthesizer output with a constant beat from a music synthesizer having at least a first and second oscillator, comprising:

generating a constant beat parameter;

adding said constant beat parameter to pitch signal to derive the input for the second oscillator; and combining the output of the second oscillator and the output from the first oscillator to generate the synthesizer output with a constant beat.

6. A method as claimed in claim 5, in which said music synthesizer further comprises first and second exponentiators wherein said first exponentiator is arranged to receive a linear pitch control signal to derive the input for said first oscillator and said method further comprises combining a detune parameter with said linear pitch control signal to derive the input for said second exponentiator.

* * * * *